United States Patent [19]

Johnson et al.

[11] Patent Number: 4,834,161

[45] Date of Patent: May 30, 1989

[54] FOLDING FIREDOOR LEAD POST ASSEMBLY

[75] Inventors: Ronald F. Johnson; J. A. Smart; E. Carl Goodman; Richard Bowles, all of Salt Lake City, Utah

[73] Assignee: Won-Door Corporation, Salt Lake City, Utah

[21] Appl. No.: 72,986

[22] Filed: Jul. 14, 1987

Related U.S. Application Data

[63] Continuation of Ser. No. 828,635, Feb. 11, 1986, abandoned.

[51] Int. Cl.[4] ..... E06B 3/94

[52] U.S. Cl. ..... 160/84.1; 160/199; 160/118; 292/335; 292/157; 292/184

[58] Field of Search ..... 160/84 R, 84 H, 84 V, 160/1, 118, 199; 292/DIG. 66, 156, 157, 162, 183, 184, 189, 335; 169/48, 59

[56] References Cited

U.S. PATENT DOCUMENTS

| | | |
|---|---|---|
| 2,151,033 | 3/1939 | Jones . |
| 2,755,081 | 7/1956 | Johnson et al. . |
| 2,789,636 | 4/1957 | Lawick . |
| 3,001,038 | 9/1961 | Gessell . |
| 3,223,147 | 12/1965 | Holloway . |
| 3,289,741 | 12/1966 | Gossling . |
| 3,446,264 | 5/1969 | Roemer . |
| 3,481,388 | 12/1969 | Smart . |
| 3,509,934 | 5/1970 | Smart . |
| 3,687,185 | 8/1972 | Singer . |
| 3,799,237 | 3/1974 | Proserpi . |
| 3,807,480 | 4/1974 | Smart . |
| 3,850,223 | 11/1974 | Tompkins . |
| 4,012,066 | 3/1977 | Salvatore . |
| 4,161,204 | 7/1979 | Kurz . |
| 4,191,412 | 3/1980 | LeKander . |
| 4,574,860 | 3/1986 | Weiss . |

*Primary Examiner*—Ramon S. Britts
*Assistant Examiner*—David M. Purol
*Attorney, Agent, or Firm*—Mallinckrodt & Mallinckrodt

[57] ABSTRACT

In order to reduce heat transfer from one side of a folding fire door lead post assembly to the other side, the lead post assembly includes a central lead post which forms the leading edge of the assembly. In one embodiment of the invention, wing panels extend from the sides of the central lead post and the receiving recess for the door when in closed condition is adapted to receive the central lead post and adjacent portions of the wing panels so that no portion of the central lead post is open to a room on either side of the door when the door is in closed condition. Heat transfer is from one wing panel to the central lead post to the other wing panel rather than directly from the fire to the central lead post. In a second embodiment of the invention, lead post side extensions are secured to the central lead post with heat insulating material therebetween. The central lead post leading edge which extends forwardly of the side extensions is adapted to be completely received within a mating female recess when the door is closed so that the only heat transfer through the lead post assembly from a fire on one side of the door is from the side extension on that side of the door, to the central lead post, to the side extension on the other side. In addition, where biparting doors are used and latching of the doors is desired, a temperature sensitve latch is provided to mechanically latch the doors together upon the fire side of the door reaching a predetermined temperature. The latch incldues at least one latching element biased to locking position and normally held in unlocked position. The latching element is released from its unlocked position upon sensing of the predetermined temperature. The temperature may be conveniently sensed by the melting of a material of the predetermined temperature which, upon melting, releases the latching element.

8 Claims, 7 Drawing Sheets

FOLDING FIREDOOR LEAD POST ASSEMBLY

This is a continuation of application Ser. No. 828,635, filed Feb. 11, 1986 now abandoned.

BACKGROUND OF THE INVENTION

1. Field

The invention is in the field of folding, room-dividing doors which serve as fire doors in case of fire.

2. State of the Art

It is common practice in many public buildings, such as churches and hotels, to use folding doors as room dividers. In open, folded condition, the doors fit out of the way into compartments in a wall of a large room, and are extended across the room when division of the large room into smaller rooms is desired. While initially such doors were used merely as dividers, some are now constructed to meet certain fire resistant specifications and can be used as fire doors in buildings. Recently, such doors have begun to be used primarily as fire doors in condominiums, apartment and office building lobbies. When used as fire doors, the doors are normally open and when a fire is sensed, are motor driven and automatically close. The doors themselves are not mechanically latched together since they have to remain manually operable for a period of time during a fire to be easily opened by people fleeing the fire. When used as fire doors, if a single door, the leading edge of the lead post assembly of the door generally fits into a receiving recess at the opposite side of the room from where the door is stored. If double or biparting doors, a section of the door is stored on each of opposite sides of a room and the door comes together intermediate the sides of the room. In such instance, one door section has the normal male leading edge on its lead post assembly which fits into a receiving female recess in the lead post assembly of the other door section. While the fire doors themselves are constructed and insulated so that with a fire on one side of the door, the opposite side of the door remains cool, the lead post assemblies of such doors are generally constructed of a single metal channel or of metal pieces connected directly together along large contact areas such that heat is readily transmitted from one side of the lead post assembly to the other causing the entire lead post assemblies to get very not. This is undesirable since all exposed parts of the door on the side opposite the fire preferably should remain cool. Further, with biparting doors, while the seal between the door sections is tight initially, since the doors are not mechanically latched together, after being subjected to intense fire heat of a period of time, the lead post assemblies tend to warp and the doors come apart. This is not acceptable under many fire codes.

SUMMARY OF THE INVENTION

According to the invention, it has been found that heat transfer from one side of a single parting door through the lead post assembly thereof to the other side of the door in closed condition can be effectively controlled so the entire exposed portion of the door on the side opposite the fire remains relatively cool by constructing the female receiving recess located in the wall to which the door is drawn when closed deep enough and wide enough to receive a substantial portion of the lead post assembly of the door. In this way, the lead post assembly of the door, when closed, is protected from the high temperature on the fire side of the door and is not exposed to touch on the opposite side of the door.

Where a normal receiving recess is used or with biparting doors, the lead post assemblies on the folding fire doors are constructed of several pieces and assembled so there is little heat transfer between the pieces. In addition, the leading portion of the male lead post assembly may be made relatively long to mate with a similarly deep receiving female recess on a female lead post assembly of a half of a biparting door so the portions of the lead post assemblies which tend to get hot are confined to the fire side of the door and the recess, while the other exposed side of the lead post assemblies remain cool. Further, a heat sensitive mechanical locking device is provided in the lead post assembly of one of the two door sections of a biparting folding fire door so that as the temperature of the lead post assemblies of thedoors increase, but prior to the individual warping of such lead posts, the mechanical latch operates to mechanically latch the lead post assemblies together thereby holding the doors together during any subsequent warping.

The latch includes at least one latching element mounted to move between an unlocked and a locking position with respect to the door with the latching element being biased toward locking position. Means is provided to hold the latching element in its unlocked position with means that release the holding means when the predetermined temperature is reached.

In a preferred embodiment of the invention, the latch includes a gravity operable latching element in one lead post assembly which is held in potential locking position at all times when the doors are closed, and when the doors are closed, is positioned above a catch on the opposite door section lead post assembly. The latching element is held in position by a heat sensitive material which melts at a predetermined temperature to allow the latching element to drop into locking position with the catch and thereby mechanically lock the door sections together. The means holding the locking element in its unlocked position may conveniently be a steel cable exending through the latching element and through opposite supporting elements of the lead post assembly, and the release means may conveniently be a lead slug at each end of the cable and adjacent the outside of the supports so that upon melting of a slug the cable is released to drop the latching element.

THE DRAWINGS

In the accompanying drawings, which illustrate the best mode presently contemplated for carrying out the invention:

FIG. 1 is a pictorial view of a portion of a room showing common general arrangements of folding fire doors of the invention;

FIG. 2, a fragmentary horizontal section taken through the lead post assembly of a single parting fire door showing its attachment to the normal door panels and with the doors in closed condition mated within a female mating groove built into a building wall;

FIG. 3, a fragmentary horizontal section taken through the male and fremale lead post assemblies of an embodiment of the invention when together in closed condition and showing their attachment to the normal door panels but not showing the locking device;

FIG. 4, a fragmentary exploded view of the male and female lead post assemblies showing an embodiment of the locking mechanism of the invention having a central portion of the various components of the lead post assembly broken away, and, for clarity, only showing the far side components of the assembly;

FIG. 5, a vertical section through the lead post assemblies as shown in FIG. 3, but shown in assembled condition with the doors in closed position so that the two lead post assemblies are adjacent one another as on the line 5—5 of FIG. 3 and showing the latch of the invention in cocked position ready for latching upon sensing the preset high temperature;

FIG. 6, a fragmentary vertical section of the portion of the lead post on the right in FIG. 5 showing the doors in open condition and the cam which prevents movement of the locking apparatus when the doors are open in its holding position;

FIG. 7, a fragmentary horizontal section taken on the line 7—7 of FIG. 5 showing the arrangement of the temperature sensitive element of the locking apparatus;

FIG. 8, a fragmentary vertical section taken on the line 8—8 of FIG. 5 again showing the arrangement of the temperature sensitive element in the locking apparatus;

FIG. 9, a fragmentary side view of the leading portion of a door section equiped with an emergency kick plate switch for operating the door;

FIG. 10, a fragmentary vertical section taken on the line 10—10 of FIG. 9;

FIG. 11, a fragmentary vertical section similar to that of FIG. 8, but showing a different embodiment of the temperature sensitive element in the locking apparatus and showing the latching element in unlatched position;

FIG. 12, a fragamentary side view of a portion of the lead post extension taken on the line 12—12 of FIG. 11; and FIG. 13, a fragmentary vertical section similar to FIG. 11, but showing the latching element in latched position.

DETAILED DESCRIPTION OF THE ILLUSTRATED EMBODIMENT

Figure 1:
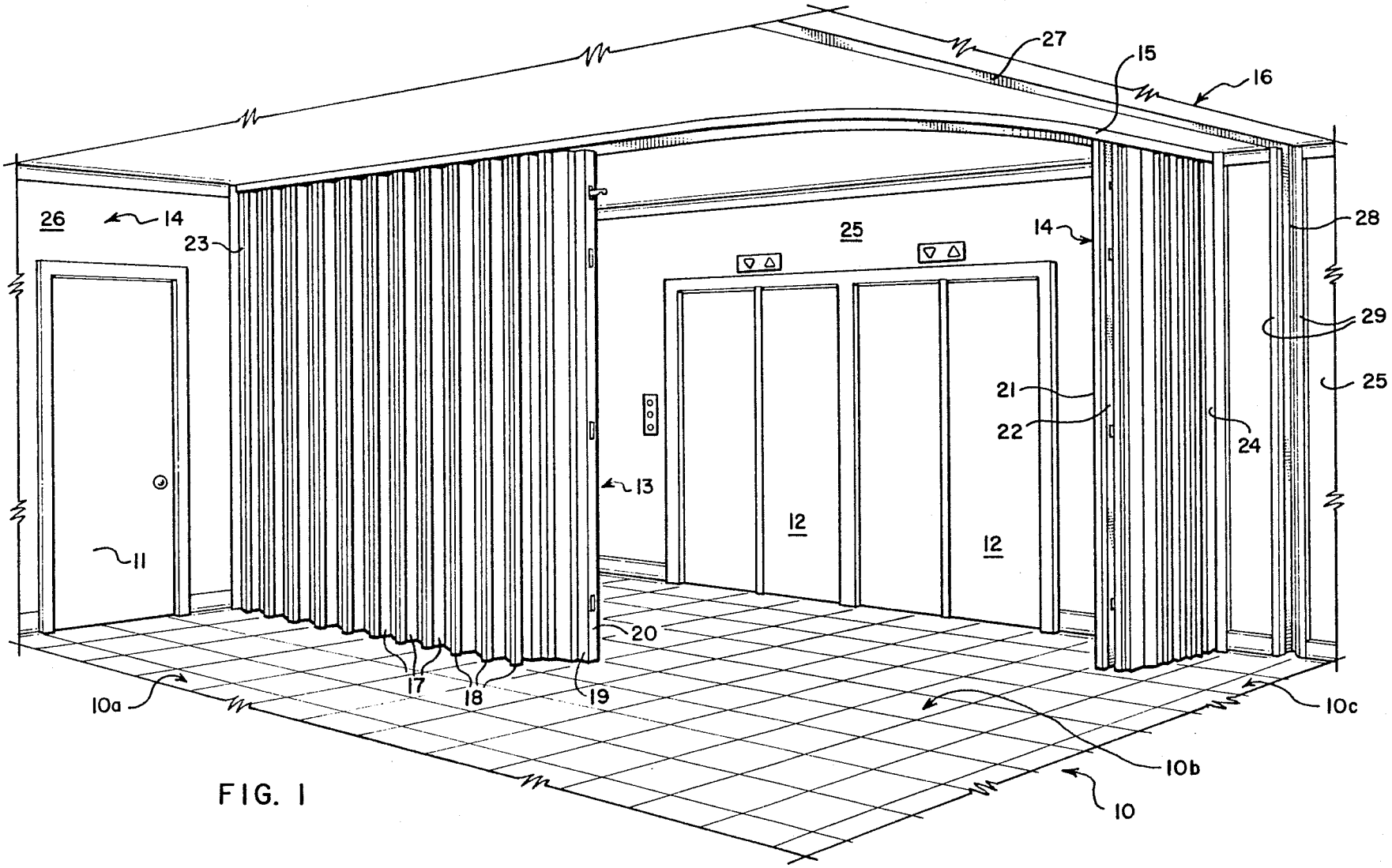

In a general arrangement of a fire door of the invention, a room 10, such as a building lobby having an entrance 11 and elevators 12, may, in case of fire, be separated by folding door sections 13 and 14 into two rooms 10*a* and 10*b* thereby separating building entrance 11 in room 10*a* from the elevators 12 in room 10*b*. The room is separated by closing door sections 13 and 14 along track 15 mounted in ceiling 16 of the room. Track 15 provides support for the door panels 17 which are suspended for folding and unfolding movement along panel hinges 18. A male lead post assembly 19 forms an extended leading edge 20 for door section 13 while female lead post assembly 21 of door section 14 forms a receiving groove 22 for the extended edge 20 of the male assembly when the doors come together in closed position. When open, the door sections are folded and may be housed completely out of the way in recesses 23 and 24 in walls 25 and 26 respectively.

While FIG. 1 shows two door sections 13 and 14, to form what is referred to as a biparting door, in many instances, depending upon the length of door needed, a single door section is used to stretch along the entire length of the track from wall to wall to form a single parting door. In such instance, the door section has a male lead post assembly similar to that shown for section 13 which mates with a groove mounted in the wall to which the door extends. Also, while FIG. 1 shows a curved track for the door to more easily illustrate the two door sections, in many, if not most instances the track will be straight and the door, when closed, will extend in a straight line between opposite walls of a room. For example, if it is desired to further divide room 10 into a third room 10c an additional track 27 can be provided in ceiling 16 extending straight across the room 10 from wall 25 to the opposite wall, not shown. A door section similar to door section 13, except in the overall extended length of the door section, is housed in the opposite wall and when extended across the room along track 27, the male leading edge, similar to edge 20, is received by mating female groove 28 formed in wall 25. Trim strips 29 give a finished appearance and form the edges for mating groove 28.

Generally when folding doors are installed as fire doors, the doors are motor driven so that in event of a fire sensed by a fire sensing system, the doors automatically close to provide the desired fire barrier. The use of the doors to separate a building entrance from elevators as shown in FIG. 1 is merely an example of where such doors are commonly used, and the doors may be used generally in any location where desired or required by fire codes.

Figure 2:
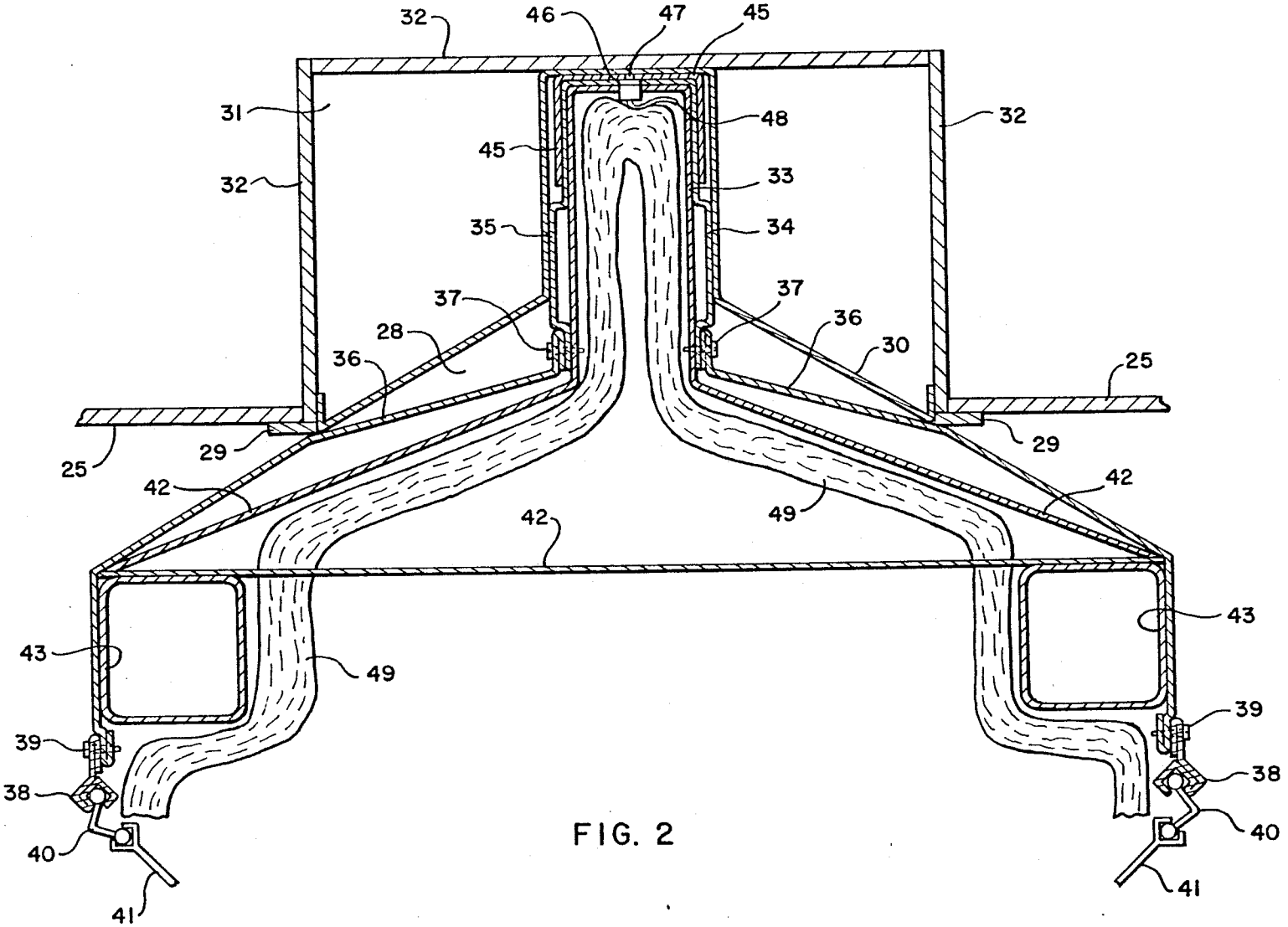

FIG. 2 is a horizontal section taken through the lead post assembly of a single parting door showing the door in closed condition with the lead post assembly mating with a receiving groove such as 28 shown in FIG. 1. As shown, groove 28 is formed by a female striker plate 30 made of steel or other suitable material and dimensioned to fit within a larger recess 31 formed in wall 25 by framing 32. Striker plate 30 is secured in place to framing 32 by any suitable means such as by screws or nails.

As shown, the male lead post assembly has central lead post means 33 basically in the form of a steel channel extending the entire height of the door. The sides of such channel are bent to form further reinforcing side channels 34 and 35. Respective wing panels 36 are secured to the trailing edges of the sides of channel 33 such as by screws 37 and extend generally outwardly and then backwardly and are secured at their trailing edge to female half hinges 38, such as by screws 39. Male hinges 40 mate with female half hinges 38 and with normal door panels 41 so as to hingedly secure door panels 41 to the lead post assembly. Additional male hinges and door panels are hingedly secured in normal side-by-side relationship to make up the desired length of folding door.

Figure 9:
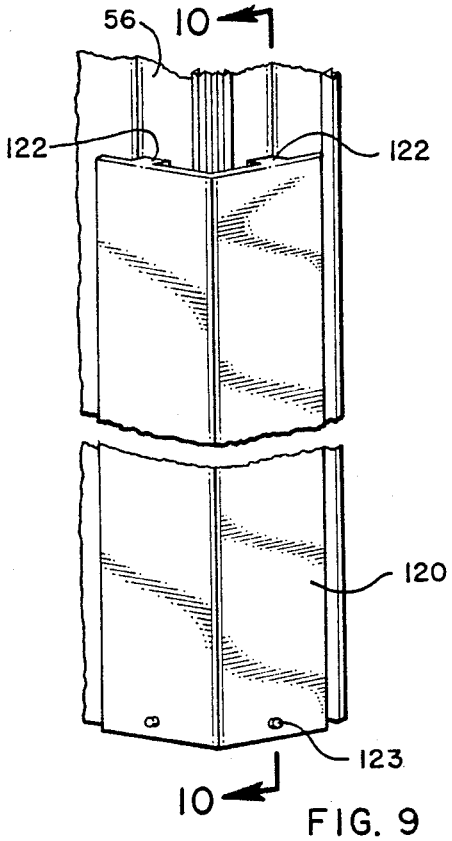
Figure 10:
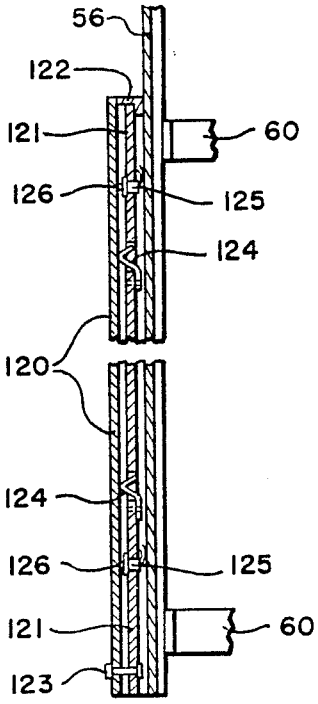

Generally, the lead post assembly will also include preferably three lead post brace assemblies 42 spaced along the height of the lead post with generally one near the top of the door, one near the bottom of the door, and one near the middle of the door. The braces 42 extend into central lead post channel 33 where they may be attached by rivets or screws and extend out along wing panels 36 giving support to wing panels 36 to keep the lead post assembly spread apart to the proper width during opening, closing, or other handling of the door. Braces 43 are secured to the back of braces 42 and add support to the rearwardly extending portions of the wing panels so that a special kick plate safety switch such as shown in FIGS. 9 and 10 may be installed.

Figure 5:
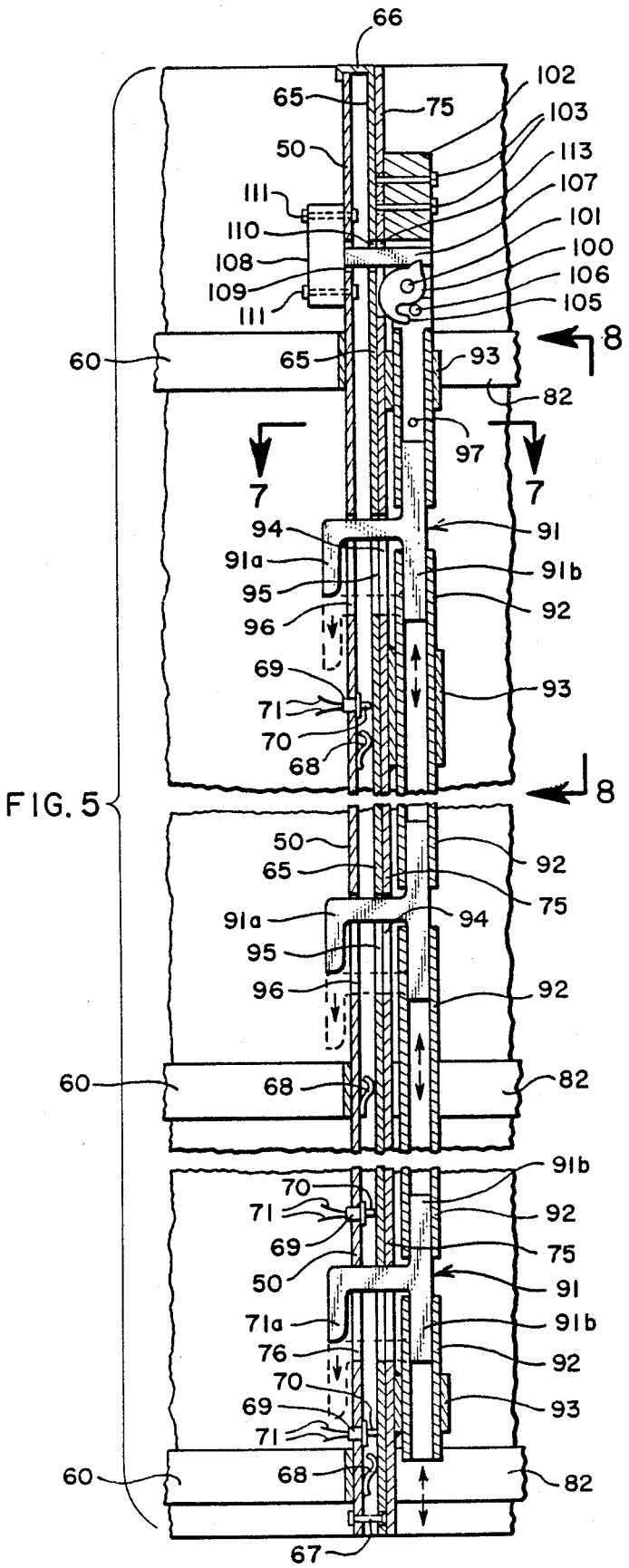

Since folding doors used as fire doors will almost always be motor drive so that the doors will automatically close upon the sensing of a fire, the central lead post 33 is provided with a safety leading edge detector in the form of a channel 45 secured to central lead post 33 in any manner for movement toward or away from such central lead post, and biased a fixed distance away from the lead post. A specific embodiment of such attachment is shown in FIG. 5 and described in relation thereto. Spaced along the height of central lead post 33 are electrical switches 46, such as microswitches, with their actuating plungers 47 extending toward channel 45. Thus, if channel 45 should hit an obstacle while the door is closing, it is pushed toward lead post 33 and actuates one or more of switches 46. Switches 46 are connected by wires 48 to the control circuitry for the door, not shown, and generally will either cause movement of the door to stop momentarily before attempting to close again, or will cause the direction of movement of the door to reverse for a predetermined distance before attempting to close again. The interior sides of hte doors are lines with a flexible heat insulating material 49 such as ceramic liner or refractory felt material. A one half inch thick, eight pound density, ceramic material made by Johns Manville has been found satisfactory for doors having fire ratings up to three hours, and two pound density, quarter inch thick fiberglass insulation has been found satisfactory for doors with fire ratings up to one hour. This material extends into lead post 33 as shown.

It will be noted from FIG. 2, that when in closed condition, central lead post channel 33 is completely housed within receiving female groove 28 and that receiving groove 28 extends partially along wing panels 36. This is important and a critical departure from the prior art in which receiving grooves are dimensioned to receive only the leading edge portion of central lead post 33. With construction of the receiving groove according to the invention as shown in FIG. 2, heat transfer from the fire side of the door to the opposite side of the door through the lead post assembly is very substantially reduced, and, except in the case of fire actually in or immediately adjacent the receiving groove, the opposite side of the door remains relatively cool to the touch. This is because the heat from the fire side of the door must be conducted along the wing panel 36 on the fire side of the door to the central lead post, along the central lead post, and then along the opposite wing panel to reach the opposite side of the door. It has been found that this heat transfer is very slow, and the increase in the size of the mating groove so that it completely encloses the central lead post means is unexpectedly very effective in reducing heat transfer.

Such an increase in the size of the receiving groove when the receiving groove is carried by a lead post assembly of a biparting door rather than being recessed into a wall of a room will not in and of itself be effective since the groove itself also has to be protected from direct transfer of heat from the fire.

Figure 3:
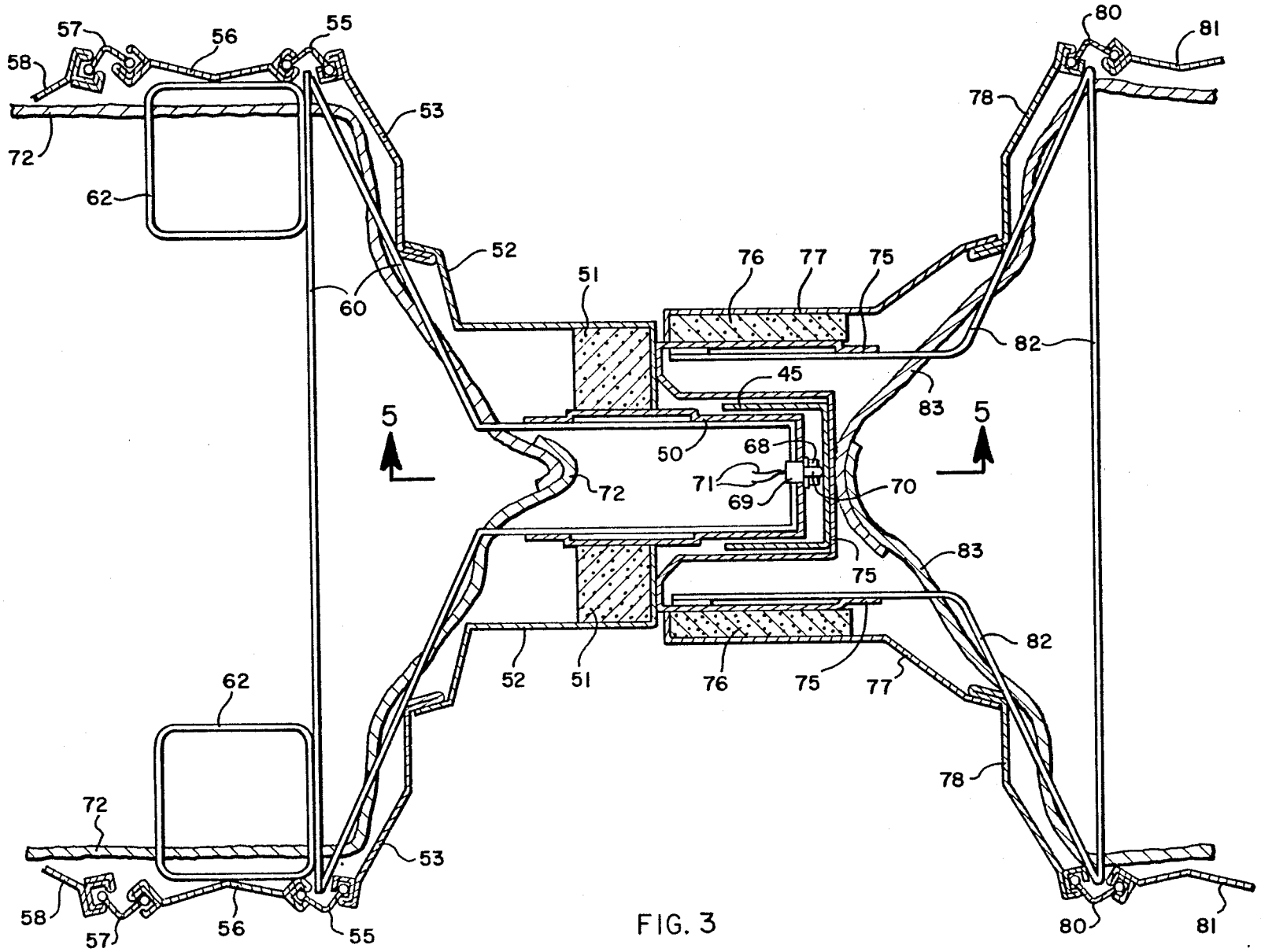

FIG. 3 is horizontal section taken through the lead post assemblies of a biparting door of the invention such as the door shown in FIG. 1 and shows the door in closed condition. For clarity, no latching element for the door is shown in this figure.

Figure 4:
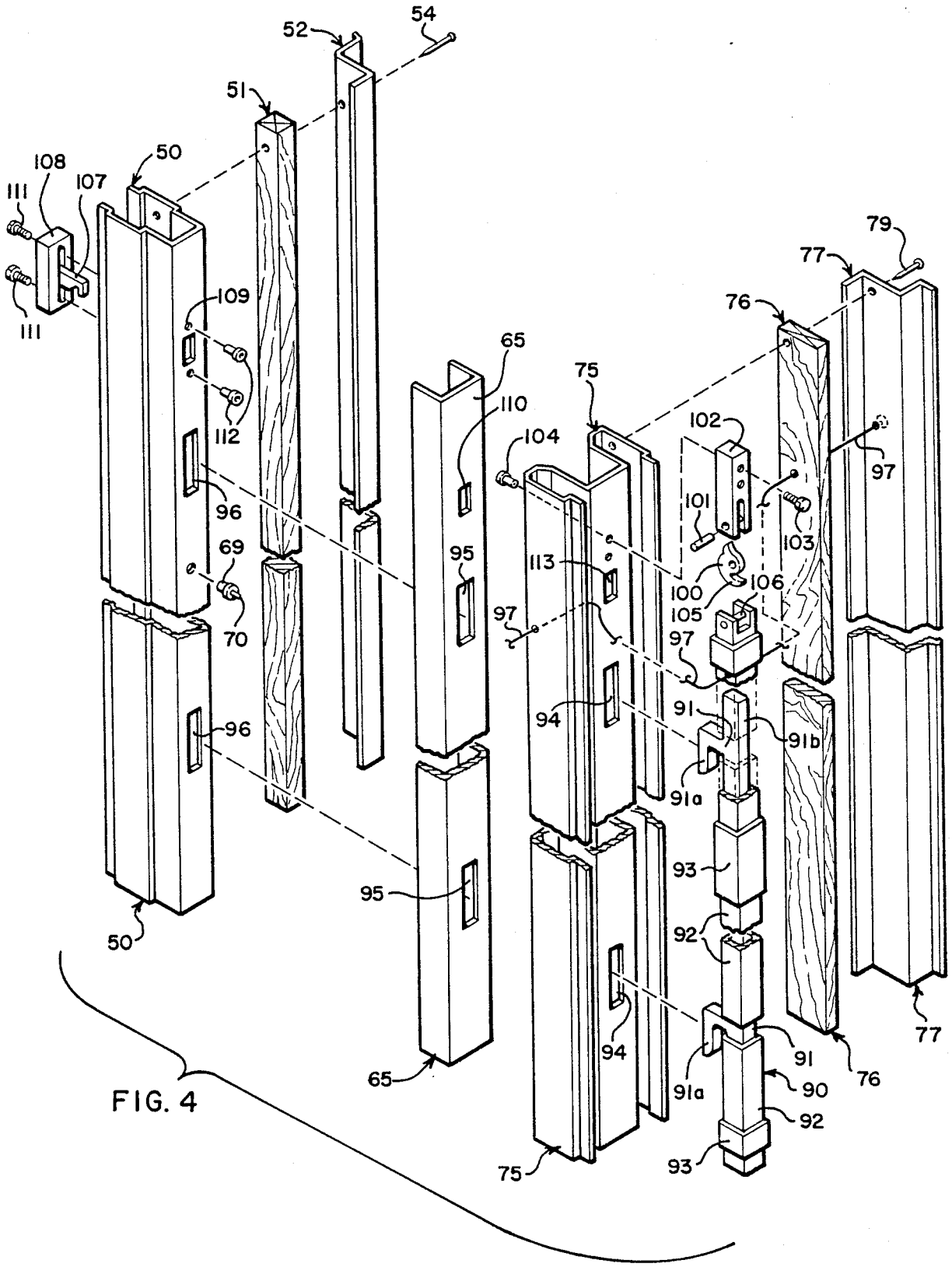

As shown in FIGS. 3 and 4, the male lead post again has a central lead post means 50 basically in the form of a steel channel extending the entire height of the door. Respective strips of heat insulating material 51, such as a refractory M-Board manufactured by Babcock & Wilcox, are positioned against the sides of central lead post means 50. Respective lead post side extension means 52 extend outwardly from each side of control lead post 50 along insulation 51 and then backwardly along insulation 51 and then somewhat outwardly again to connect with wing panels 53. The respective lead post side extension means are preferably made of steel sheet material and may be secured, along with insulation 51, to central lead post 50 by means of screws 54, FIG. 4, or other fasteners extending through the lead post extension and insulation to central lead post 50. The wing panels may be secured to the lead post extensions by means of screws or other fasteners. The outer ends of the wing panels are configured in normal manner to accept one end of a folding door male hinge 55, the other end of which hingedly mates with a special half door panel 56. Male hinges 57 mate with the other end of half panels 56 and hingedly secure normal door panels 58 thereto. Additional door panels are secured in normal side-by-side configuration to make up the desired length of folding door.

Generally, the lead post assembly will also include preferably three lead post brace assemblies 60 (not shown in FIG. 4) spaced along the height of the lead post with generally one near the top of the door, one near the bottom of the door, and one near the middle of the door, see FIG. 5. The braces 60 extend into central lead post 50 where they may be attached by rivets or screws and extends out to hinges 55 giving support to wing panels 53 to keep the lead assembly spread apart to the proper width during opening, closing, or other handling of the door. Braces 62 are secured to the back of braces 60 and add support to half panels 56 which are provided and supported by braces 60 so that a special kick plate safety switch such as shown in FIGS. 9 and 10 may be installed.

A safety leading edge detector in the form of a channel 65 is hingedly secured to the top of central lead post 50 by hanger 66, FIG. 5, which may be formed as an integral part of channel 65. Channel 65 is held in place at its bottom by pin 67 and is biased away from central lead post 50 by springs 68. Spaced along the height of central lead post 50 are electrical switches 69, such as microswitches, with their actuacting plungers 70 extending toward channel 65. Thus, if channel 65 should hit an obstacle while the door is closing, it is pushed toward lead post 50 and actuates one or more of switches 69. Switches 69 are connected by wires 71, FIGS. 3 and 5, to the control circuitry for the door, not shown, and generally will either cause movement of the door to stop momentarily before attempting to close again, or will cause the direction of movement of the door to reverse for a predetermined distance before attempting to close again. The interior sides of the doors are lined with a flexible heat insulating material 72 such as the ceramic liner or refractory felt material described in connection with FIG. 2. This material extends into lead post 50 where generally it will be overlapped as shown.

With a biparting door, the leading edge of the male lead post assembly described is received by a groove in a female lead post assembly on the opposite door section. The receiving groove is formed by a central lead post means 75, FIG. 3. As with the central male lead post 50, insulating material 76 such as M-Board refractory material is secured to the sides of female lead post 75 and lead post side extensions 77 extend from the respective sides of lead post 75 to cover the insulation 76 and then extend somewhat outwardly to join with respective wing panels 78. Again, the respective lead post side extensions 77 and insulating material 76 can be secured to central lead post 75 by screws 79, FIG. 4, or other appropriate fastening means and wing panels 78 can be secured to lead post extensions 77 by screws or other appropriate fastening means. The end of wing panels 78 are configured to accept a male hinge 80 which hingedly attaches at its other end to normal door panels 81. Additional male hinges and door panels are connected side-by-side to make up the desired length of door. Lead post braces 82 are provided similarly to braces 60 preferably near the top, bottom, and middle of the lead post 75 in order to brace wing panels 78 and help hold them in their extended position. Half panels similar to 55 connected to the male lead assmebly are not generally provided for the female lead assembly because the safety kick plate switch mounted on such half panels are generally needed on only one door section. Flexible heat insulating material 83 lines the interior of the door and preferably overlaps adjacent to central lead post means 75.

It will be seen that with the construction illustrated, the lead post extensions 52 and 77 are separated from the central lead posts 50 and 75 respectively, by insulating material, the only direct contact being along a line contact where one edge of each extension meets the central lead post. Since the area of this line contact is small, there is very little heat transfer directly from the lead post extension to the central lead post and then around the lead post and to the opposite lead post extension. Thus, the lead post extension on the fire side of the door may be very hot, but the lead post extension on the opposite side of the door will remain cool.

With the construction shown, the female receiving groove is made deep enough to accept the entire leading edge of the male central lead post with the male lead post extensions actually abutting the female central lead post adjacent the groove. Further, most of the female central lead post is shielded by the insulation and lead post extensions so that the central lead posts are substantially shielded from direct exposure to the heat of a fire on the fire side of the door. This limits heating of the central lead post to only the heat transferred through the insulation or line contacts with the lead post extensions. Where a single parting door is used having the male lead post construction as shown in FIG. 3, the female receiving groove built into the building wall may be configured to abut the lead post extensions of the lead post assembly as does the female receiving groove of FIG. 3, rather than being as wide as shown in FIG. 2. The use of the deep receiving groove and the lead post extensions has been found extremely effective in limiting heat transfer from one side of the door to the other.

As previously mentioned, with biparting doors, when the temperature on one side of the door gets extreme, for example above about 500° F., there is a possibility that the lead posts will warp and may separate. To prevent this separation, it is desireable to mechanically latch the doors together. Such mechanical latching is not desireable, however, when people may be fleeing the fire and must open the door to escape. Where mechanical latching is desired, the present invention provides a mechanical, temperature sensitive locking apparatus which mechanically latches the male and female lead post assemblies together when the temperature on the fire side of the door reaches a preset minimum. This minimum temperature will be less than the temperature that causes warping of the lead posts to ensure that the lead posts are locked by the time they reach warping temperature, but will be sufficiently high so there could no longer be life trying to escape from the fire. FIGS. 4 through 8 show the latching apparatus. As shown, a latching bar 90 is made up of a plurality of latching hook members 91 having hook portions **91*a* and rectangular shank portions 91*b* and connected by rectangular tubing 92 welded or otherwise attached to the shank portions 91b. The latching bar 90 is mounted for limited vertical travel on female lead post 75 by guides 93 secured by welding or other suitable means to the inside of the central lead post means 75. The latching hook portions 91a of hook members 91 extend through slots 94 in central lead post means 75, and, when the doors are in closed position, extend through mating slots 95 and 96 in the leading edge detector 65 and central male lead post 50, respectively, as shown in FIG. 5, so as to be in cocked, but unlocked position. As shown, if latching bar 90 moves downwardly, latching hooks 91a will engage male lead post 50** and prevent the door from separating. It is preferred to provide hook members about every eighteen inches along the height of the lead posts.

Figure 7:
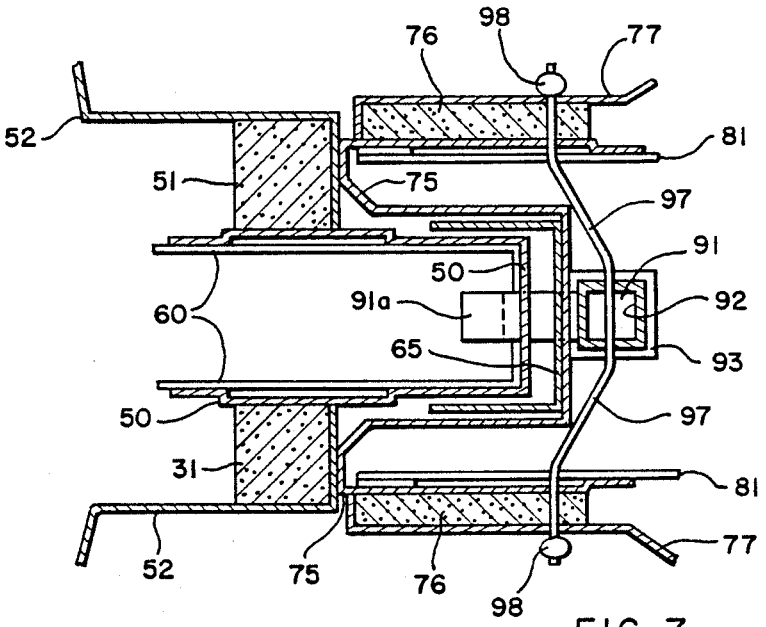
Figure 8:
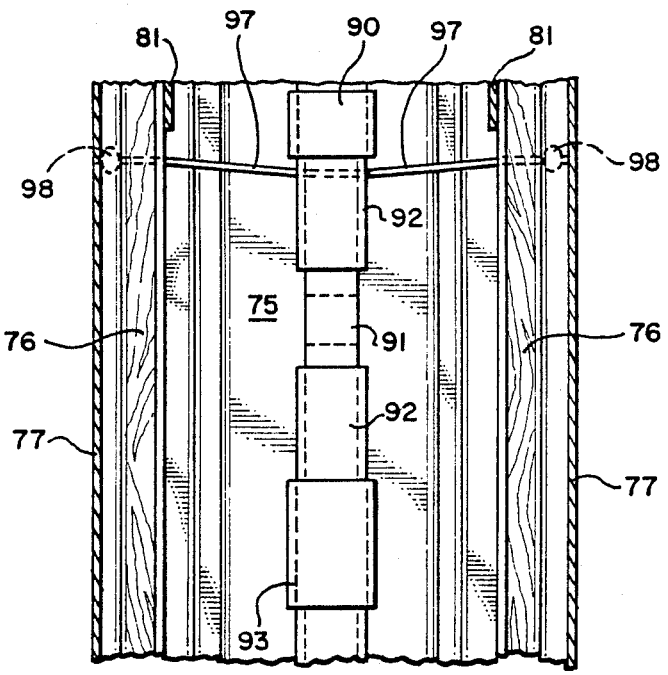

Latching bar 90 is biased toward its down or locked position by gravity and is held in up, cocked, but unlatched position by cable 97 which extends through connecting tube 92 of latching bar 90, through the outer side walls of lead post 75, insulation 76, and lead post extensions 77, where cable 97 terminates with respective beads 78, FIGS. 7 and 8, of material which melts at a predetermined temperature to release the holding cable and allow the latching bar 90 to move downwardly to its locking position. It is presently preferred to use a lead material to form beads 98 and No. 9 oval egg fishing sinkers which are crimped onto ends of the cables are presently preferred. However, various other materials which melt at a desired temperature may also be used. Also, while latching bar 90 is shown biased toward its locking position by gravity, various other bias means, such as springs, could be used.

Figure 6:
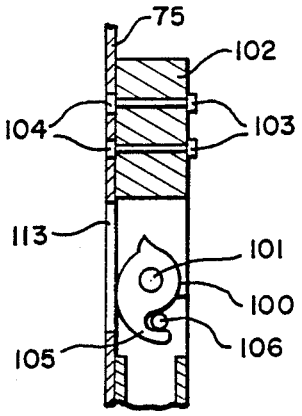

When using material such as lead, which is soft, crimped onto the end of the cable, such material has a tendency to allow the cable to slide therethrough over time in response to constant pressure thereon, and to allow more slippage in response to sudden pulls. In order to ensure that the beads on the cable are not jarred loose during opening, closing, and other handling of the doors, a safety catch to hold the latching bar 90 in up position when the door is open is provided in the form of a cam 100 rotatably held by shaft 101 in bracket 102 secured to female central lead post 75 such as by screws 103 and fastener nuts 104. Hook 105 of cam 100 in its normal position when the doors are apart as shown in FIG. 6, engages holding pin 106 mounted at the top of latching bar 90 and securely holds latching bar 90 in its up position. This releases pressure on cable 97.

When the doors are closed, cam operating lever 107 extending from mount 108, through holes 109 and 110 in lead post 50 and leading edge detector 65, respectively, and secured to male central lead post 50, such as by screws 111 and fastener nuts 112, extends through hole 113 in female lead post 75 to contact cam 100 and cause it to rotate to its released position shown in FIG. 5 to enable latching bar 90 to drop upon release of cable 97. Thus, during a fire with the doors closed, when the temperature on the fire side of the lead post increases to that necessary to melt the bead 98, latching member 90 is released and moves downwardly to lock the doors together.

Since the fire doors of the invention are motor driven, in many instances it is desireable to provide a so called "kick plate" safety switch so that the door can be opened a predetermined distance for a predetermined time for people escaping the fire. The kick plate switch is shown in FIGS. 9 and 10 and is adapted specifically to be operable by handicapped persons in wheelchairs by hitting the plate in some manner such as by running the wheelchair into the plate.

The kick plate switch includes a plate 120 which extends from about normal door handle height around thirty nine inches above the floor down to the bottom of the door. It is mounted for movement toward or away from the door on mounting plate 121 which is spaced from and secured in any suitable manner such as by screws to the half panel 55 at the back of the male lead assembly. Hanger 122, which may be integrally formed with plate 120, holds the top of plate 120 to mounting plate 121 while pin 123 holds the bottom of kick plate 120 in position. Kick plate 120 is biased away from the door by flat springs 124 and mounted on support 121 are a plurality of electrical switches 125, such as microswitchs, with actuating plungers 126 toward kick plate 120. Thus, when kick plate 120 is hit so that it moves toward support 121, one or more microswitches are operated. The microswitches are connected to the control circuity such that operation of one or more of such switches causes the door to open a predetermined distance for a predetermined time to allow the person operating the kick plate to escape from the fire. After being pushed toward the support 121 and pushing pressure being released, kick plate 120 will be forced away from the support 121 by springs 124. Hanger 122 and pin 123 establish the distance under normal spring bias between the kick plate and the support. Normally a kick plate switch will be mounted on each side of the male section of the doors.

Figure 11:
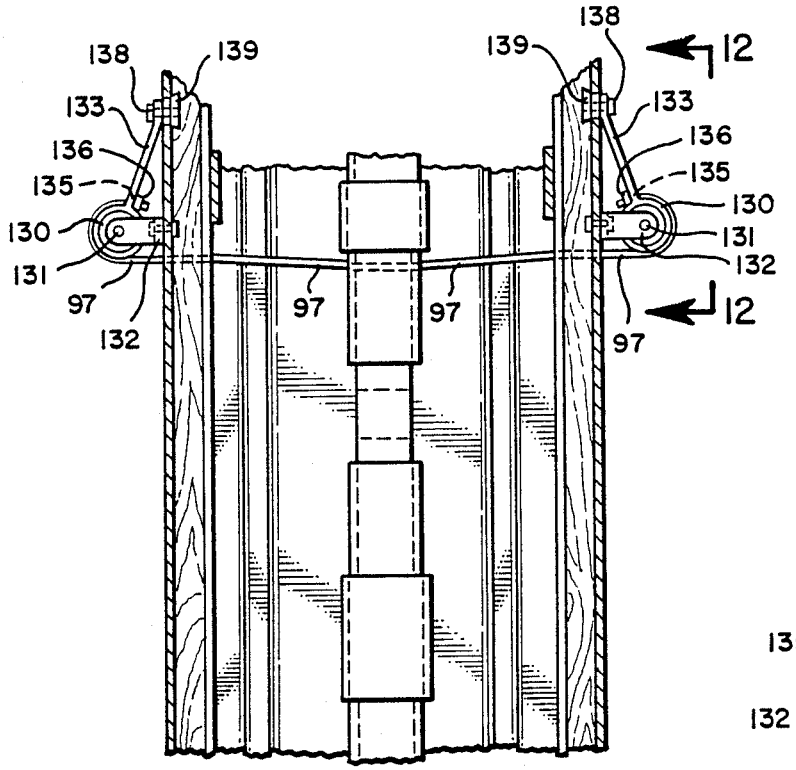
Figure 12:
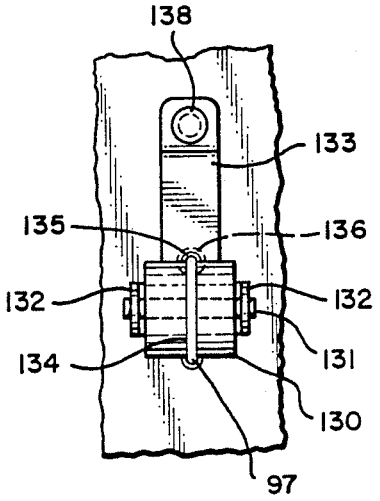
Figure 13:
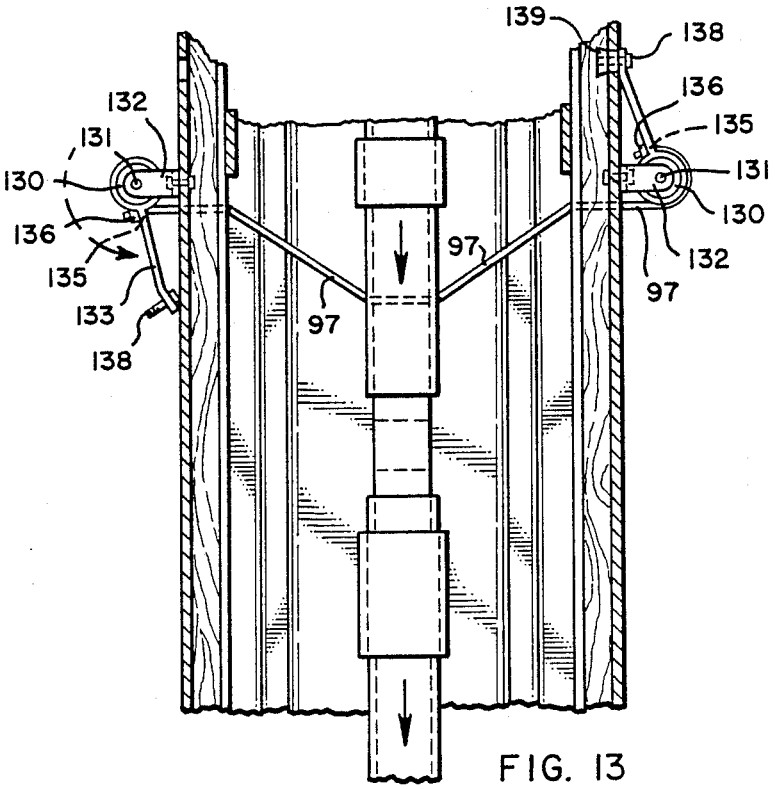

FIGS. 11–13 show an alternative embodiment of the temperature sensitive locking apparatus that does not use the beads 98 at the ends of cable 97. Instead, as shown in FIGS. 11–13, the respective ends of cable 97 are wrapped around respective spools 130 mounted by pins 131 for rotation in brackets 132 secured to respective door lead post side extensions 77. Respective arms 133 are secured to and extend outwardly from spools 130 and rotate with spool 130. Guide grooves 134, FIG. 12, are provided in spools 130 to receive cable 97 as it is wound on the spools and cable 97 is passed through receiving holes 135 in arms 133 where its ends are secured in any suitable fashion such as by normal cable sleeves 136 crimped onto the cable. The cable is secured to the spools so that as the arms are rotated upwardly, to their up position shown in FIGS. 11 and 12, the cable is wrapped about one half of the spool. In their up position, arms 133 are secured to lead post side extensions 77 by screws 138 and lead anchors 139 which are inserted through lead post side extensions 77. Lead anchors 139 are selected to melt at the predetermined temperature.

With both spool arms 133 in their up position as shown in FIG. 11, the cable is held taut and holds the latching bar 90 in its cocked, up, unlatched position.

In the event of a fire on one side of the door, as the temperature of the lead post extension 77 increases and reaches the predetermined temperature, lead anchor 139 holding screw 138 on that side melts thereby releasing screw 138 and allowing spool 130 to rotate to the position shown in FIG. 13. This unwinds the cable wrapped on the spool and allows latching bar 90 to move downwardly into latched position.

It currently appears that this alternate embodiment may be the preferred embodiment because when used, the cam 100 and cam operating means 107 is not needed. The cable 97 can be securely attached to spools 130 and the use of arms 133 with the screws 138 and lead anchors 139 provide a much more secure attachment than does merely crimping the lead bead to the end of the cable. The lead anchor is inserted into the lead post in a secure manner and because arms 133 act as levers and provide a mechanical advantage in terms of the force on screws 138, they exert less force on screws 138 than the forces actually exerted by cable 97 to rotate spool 130. In this manner, the latching bar 90 is held securely in unlatched, cocked, up position during movement of the door and the auxiliary holding means provided by cam 100 is not necessary.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In combination with a folding fire door including two folding door sections which come together to form the closed fire door, one section having lead post means forming a male leading edge and the other section having lead post means forming a female receiving groove for receiving the male leading edge of the other section when the doors are in closed condition, a temperature sensitive lock for use in locking the fire doors in closed condition after the temperature of the fire side of said lead post assemblies of the door reach a predetermined level, comprising at least one catch element formed in one of the lead post means; at least one latching element mounted in the other of the lead post means and mounted for movement between an unlocked and a locking position with respect to the at least one catch element when the door is in closed condition, said latching element being biased toward locking position; a flexible cable extending from one side of the lead post means in which the latching element is mounted to the other and being coupled to the latching element; and holding means on the respective sides of said lead post means for normally holding the flexible cable in a shortened, taut condition between the sides of the lead post means and for releasing the cable upon sensing the predetermined temperature level thereby normally holding the latching element in its unlocked position where it does not interfere with free movement of the respective door sections in either open or closed condition but releasing the flexible cable upon sensing the predetermined temperature level whereby the latching element is released to move to locking position.

2. A combination according to claim 1, wherein the latching element moves in a downward direction from its unlocked to its locking position and is biased toward its locking position by gravity.

3. A combination according to claim 1, wherein the holding means are lead beads crimped onto respective end portions of the cable and adapted to melt at the predetermined temperatures.

4. A combination according to claim 1, wherein the holding means are spools about which respective end portions of the cable are wound.

5. A combination according to claim 4, wherein the means for releasing the holding means includes an arm secured to and extending from each respective spool and rotatable with such spool and temperature sensitive anchor means for anchoring the respective arms in rotated position so that upon reaching the predetermined temperature, the anchor means reaching such temperature releases the arm of its respective spool which is then allowed to rotate and unwind the cable.

6. A combination according to claim 5, wherein the anchor means are lead anchors secured to repsective sides of the door and respective screws passing through the respective arms and threaded into respective anchors, said anchors selected to melt at the predetermined temperature to thereby release the screws and respective arms.

7. A combination according to claim 1, wherein the at least one catch element is mounted in the lead post assembly forming the male leading edge, and wherein the at least one latching element is mounted in the lead post assembly forming the female recess therein so that said at least one latching element extends into said recess and is adapted to extend into position with respect to the at least one catch element when the doors are in closed condition so that release of the latching element will allow it to move to locking position.

8. A combination according to claim 7, wherein the at least one catch element is a receiving hole in the male leading edge adapted to receive the latching element.

* * * * *